US009878870B2

(12) United States Patent
Dchalk et al.

(10) Patent No.: US 9,878,870 B2
(45) Date of Patent: Jan. 30, 2018

(54) PRINT MEDIA EJECTION

(71) Applicant: Hewlett-Packard Development Company, L.P., Houston, TX (US)

(72) Inventors: Wesley R Dchalk, Camas, WA (US); Mark H MacKenzie, Corvallis, OR (US); Bruce A Axten, Camas, WA (US); Francisco Javier Gomez Maurer, Vancouver, WA (US); Catherine Elizabeth Gould, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/521,867

(22) PCT Filed: Jan. 30, 2015

(86) PCT No.: PCT/US2015/013991

§ 371 (c)(1),
(2) Date: Apr. 25, 2017

(87) PCT Pub. No.: WO2016/122669

PCT Pub. Date: Aug. 4, 2016

(65) Prior Publication Data

US 2017/0334673 A1 Nov. 23, 2017

(51) Int. Cl.

| | |
|---|---|
| ***B65H 43/00*** | (2006.01) |
| ***B65H 29/12*** | (2006.01) |
| ***B65H 29/14*** | (2006.01) |

(52) U.S. Cl.

CPC ..... *B65H 43/00* (2013.01); *B65H 29/125* (2013.01); *B65H 29/14* (2013.01); (Continued)

(58) Field of Classification Search

CPC ..... B65H 43/08; B65H 29/68; B65H 29/125; B65H 29/14; B65H 2513/108

(Continued)

(56) References Cited

U.S. PATENT DOCUMENTS

| | | | |
|---|---|---|---|
| 6,264,194 | B1 | 7/2001 | Hayashi et al. |
| 7,529,494 | B2 | 5/2009 | Won |

(Continued)

FOREIGN PATENT DOCUMENTS

| | | |
|---|---|---|
| JP | 07-223342 | 8/1995 |

OTHER PUBLICATIONS

Nakamura, M. et al., "High-speed Techndogy for Flat Bed Printers," (Research Paper), Aug. 1998, 6 pages, http://www.oki.com/.

*Primary Examiner* — Patrick Cicchino

(74) *Attorney, Agent, or Firm* — HP Inc. Patent Department

(57) ABSTRACT

According to an example, to eject print media from an image forming apparatus, a variable page feed velocity of a first page of print media exiting a feed zone is detected. An acceleration value and a deceleration value based on the variable page feed velocity of the first page is calculated. The calculated acceleration is applied to a media movement component in the output zone when the entire first page has cleared a media sensor in the front of the output zone, and the deceleration is applied when the tail end of the first page is in a brake zone. In some examples, a second page of print media and a variable page feed velocity of the second page exiting the feed zone is detected, and the media movement component in the output zone is accelerated to match the variable page feed velocity of the second page.

15 Claims, 5 Drawing Sheets

(52) U.S. Cl.
CPC ..... *B65H 2301/44522* (2013.01); *B65H 2513/10* (2013.01); *B65H 2513/108* (2013.01); *B65H 2557/242* (2013.01); *B65H 2701/1313* (2013.01)

(58) Field of Classification Search
USPC ..... 271/114
See application file for complete search history.

(56) References Cited

U.S. PATENT DOCUMENTS

| | | | | |
|---|---|---|---|---|
| 8,152,168 | B2 | 4/2012 | Rossfeldt | |
| 8,387,978 | B2 | 3/2013 | Fukasawa et al. | |
| 8,909,123 | B2 * | 12/2014 | Moriyama | B41J 3/60 399/361 |
| 2002/0060804 | A1 | 5/2002 | Mochimaru et al. | |
| 2007/0019061 | A1 | 1/2007 | Koyabu et al. | |
| 2007/0228649 | A1 | 10/2007 | Mizutani et al. | |
| 2008/0165216 | A1 | 7/2008 | Lee | |
| 2008/0180476 | A1 | 7/2008 | Igarashi | |
| 2012/0263514 | A1 | 10/2012 | Tanami et al. | |
| 2017/0036879 | A1 * | 2/2017 | Tokuma | B65H 31/10 |

* cited by examiner

PRINT MEDIA EJECTION

BACKGROUND

An image forming apparatus, such as a printer, may allow for printing on various types of media using technologies such as inkjet, thermal, or laser. With some print technologies, individual pages in a single print job may be printed at varying speeds due to, for example, differences in the required coverage of a page, desired print modes, or other factors. Due to these differences in the print speed of pages in a particular job, print media may be ejected from the printer, e.g., into an output bin, at varying speeds.

BRIEF DESCRIPTION OF THE DRAWINGS

The following detailed description references the drawings, wherein.

DETAILED DESCRIPTION

Figure 1:
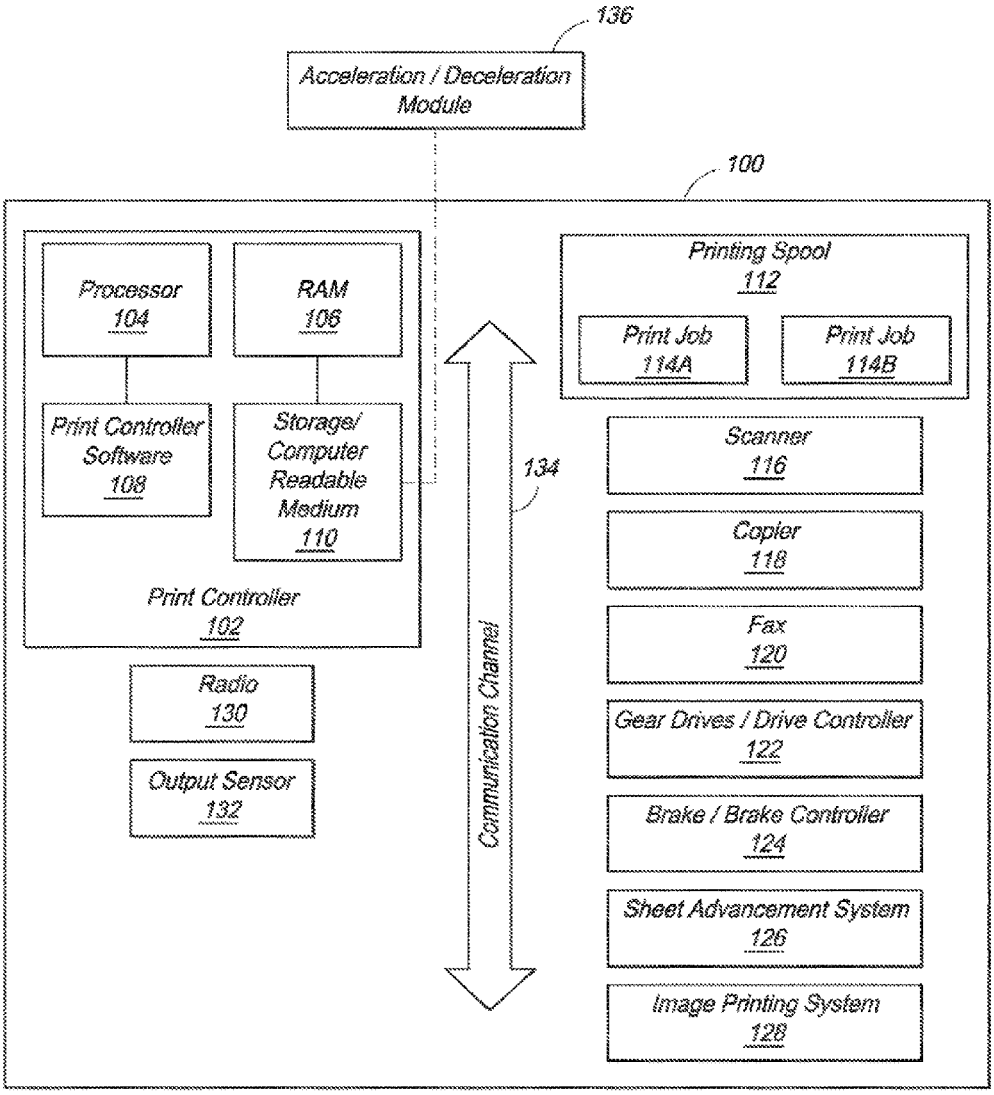
FIG. 1 is a block diagram of an image forming environment to accelerate and decelerate print media in an output zone, according to an example of the present disclosure.

Developments in printing technology have allowed image-forming devices such as printers to reliably print at a high rate of speed, while at the same time allowing for a reduction in the overall size of the device, the enablement of duplex printing capabilities, and the use of thin, environmentally-friendly papers, all of which improve the user experience. In addition to these factors, another factor relevant to the user experience when printing is the quality of the print media output stack, e.g., the alignment and separation of sheets ejected from the printer.

More specifically, a properly aligned output stack provides for a professional appearance of a print job and requires less time to manually align the print job when removing the sheets from the printer, which may be of particular importance when stapling or hole-punching a print job. Moreover, an aligned output stack may allow for job offset, where multiple jobs can be ejected into a single output bin in visually separate piles, which may be of particular importance when printing multiple jobs at one time, especially in environments where a printer is shared between users.

Advancements in printing technologies and features such as those allowing for print speed throughput increases may have negative consequences, such as a decrease in the quality or alignment of the output stack. For example, high speed printers may need to maintain as small a gap as possible between pages to allow for high print throughput. In such examples, pages in a print job that are printed at high speed and also ejected at high speed may result in an output stack that is not well-aligned given the eject force and velocity of each sheet as it exits the printer. In these cases, due to the small gap between pages, the printer cannot simply brake a page during ejection, as a second page may be immediately behind the first page that is being ejected.

Accordingly, it may be desirable to accelerate a page when the page is in an output zone to create a larger gap between the first page and a second page behind it that has not yet entered the output zone. The first page may then be quickly braked in the last stages of ejection without affecting the second page behind it. In such a case, the first action of an acceleration or "boost" may be a consequence of the need for a second action, i.e., to decelerate or break just prior to ejection of a page.

However, such an arrangement may present additional complications in print technologies that employ variable printing speeds, where a rudimentary acceleration and deceleration routine may not be appropriate. For example, an inkjet printer may allow for variable print speeds on a page-by-page basis within a particular job, enabling the printer to increase the overall print throughput. Pages in a print job that require minimal ink coverage, such as pages with text or pages printed in draft mode, may print at a higher speed than pages with graphics or pages printed in a best quality mode.

According to an example, to eject print media from an image forming apparatus such as a printer, a variable page feed velocity of a first page of print media exiting a feed zone is detected. An acceleration value and a deceleration value based on the variable page feed velocity of the first page is calculated. The calculated acceleration is applied to a media movement component in the output zone when the entire first page has cleared a media sensor in the front of the output zone, and the deceleration is applied when the tail end of the first page is in a brake zone. In some examples, a second page of print media and a variable page feed velocity of the second page exiting the feed zone is detected, and the media movement component in the output zone is accelerated to match the variable page feed velocity of the second page.

FIG. 1 is a block diagram of an image forming apparatus to accelerate and decelerate print media in an output zone, according to an example of the present disclosure. As used herein, an image forming apparatus may be a printer, copier, fax machine, or other apparatus capable of, for example, printing, copying, faxing, and/or otherwise producing print media (hereinafter simply a "printer"). A printer may print to pages or sheets of media.

In examples described herein, a printer may include a processing resource. A processing resource may include, for example, one processor or multiple processors included in a single device or distributed across multiple devices, as discussed below in more detail.

In the example of FIG. 1, printer 100 comprises a print controller 102. Print controller 102 may include a processing resource 104 such a processor, a memory 106, and a machine-readable storage medium 110 comprising (e.g., encoded with) a module and/or instructions 136 executable by processing resource 104.

As used herein, a "processor" may be at least one of a central processing unit (CPU), a semiconductor-based microprocessor, a graphics processing unit (GPU), a field-programmable gate array (FPGA) configured to retrieve and execute instructions, other electronic circuitry suitable for the retrieval and execution of instructions stored on a machine-readable storage medium, or a combination thereof. Processing resource 104 may fetch, decode, and execute instructions stored on storage medium 110 to per-form the functionalities described below. In other examples, the functionalities of any of the instructions of storage medium 110 may be implemented in the form of electronic circuitry, in the form of executable instructions encoded on a machine-readable storage medium, or a combination thereof.

As used herein, a "machine-readable storage medium" may be any electronic, magnetic, optical, or other physical storage apparatus to contain or store information such as executable instructions, data, and the like. For example, any machine-readable storage medium described herein may be any of Random Access Memory (RAM), volatile memory, non-volatile memory, flash memory, a storage drive (e.g., a hard drive), a solid state drive, any type of storage disc (e.g., a compact disc, a DVD, etc.), and the like, or a combination thereof. Further, any machine-readable storage medium described herein may be non-transitory. In examples described herein, a machine-readable storage medium or media is part of an article (or article of manufacture). An article or article of manufacture may refer to any manufactured single component or multiple components. The storage medium may be located either in the computing device executing the machine-readable instructions, or remote from but accessible to the computing device (e.g., via a computer network) for execution.

In some examples, instructions stored on machine-readable storage medium may be part of an installation package that, when installed, may be executed by processing resource 104 to implement the functionalities described herein in relation to instructions. In such examples, storage medium 110 may be a portable medium, such as a CD, DVD, or flash drive, or a memory maintained by a server from which the installation package can be downloaded and installed. In other examples, instructions may be part of an application, applications, or component(s) already installed on an image forming apparatus 100 including processing resource 104. In such examples, the storage medium 110 may include memory such as a hard drive, solid state drive, or the like.

In the example of FIG. 1, module or engine 136 stored on print controller 102 may include at least instructions 508 through 515, discussed below with respect to FIG. 5, to implement at least some of the functionalities described herein. Module 136 may be any combination of hardware and programming to implement the functionalities of the respective module or engine. In some examples, storage medium 110 may include additional instructions, in other examples, the functionalities described herein in relation to instructions 136, and any additional instructions described herein in relation to storage medium 110, may be implemented as engines comprising any combination of hardware and programming to implement the functionalities of the engines, as described below.

In the example of FIG. 1, printer 100 also includes a radio or network interface device 130. In examples, a network interface device may be a hardware device to communicate over at least one computer network. In some examples, a network interface may be a network interface card (NIC) or the like. As used herein, a computer network may include, for example, a local area network (LAN), a wireless local area network (WLAN), a virtual private network (VPN), the Internet, or the like, or a combination thereof. In some examples, a computer network may include a telephone network (e.g., a cellular telephone network).

In the example of FIG. 1, printer 100 may also include an output or media sensor 132 (hereinafter "media sensor"), such as a sensor for detecting the presence of media in a particular location within the printer. In some examples, media sensor 132 may also detect which part of a medium is passing by the sensor at any given time. For example, media sensor 132 may detect that the trailing edge, or the last inch for example, of a page is passing the sensor.

Printer 100 may also include a printing spool 112. A printing spool 112 may include data of multiple print jobs, including at least one print job 114A that has been queued for printing. Print controller 102 may access each print job and the data inside each print job when they are ready to be printed.

Printer 100 may also include a scanner 116, a copier 118, and a fax 120, or such capabilities. For example, printer 100 may be a multi-function printer.

Printer 100 may also include a controller for gear drives 122 and a controller for a brake 124, as discussed below in more detail, which may connect or be coupled to one or more media movement components such as gears, brakes, motors, or rollers, for example. The print controller 102 may instruct the gears, brakes, motors, rollers, and/or other internal media movement components of the printer to rotate at a particular speed at a given time.

In one example discussed below in more detail, the print controller 102 may instruct the gears, brakes, motors, rollers, and/or other internal components of the printer to rotate at an accelerated or decelerated speed to eject a first page. After a first page has been ejected from the printer, the print controller 102 may send a second instruction for the gears, brakes, motors, rollers, and/or other internal components of the printer to rotate at a different speed, as described below in more detail and in combination with the instructions stored in module 136.

Printer 100 may include a sheet advancement system 126 and an image printing system 128. When printing each page of each print job in the printing spool 112, the print controller 102 may initially send instructions to the sheet advancement system 126 to acquire pages from one or more input bins. The print controller 102 may then send an instruction for the sheet advancement system to transfer one or more pages to the image printing system, discussed below, where the print controller 102 may utilize the data from each print job to determine what images, text, and/or patterns are to be printed on each page of the corresponding print job, as well as the number of pages to be printed on each side of a sheet.

The general method disclosed above may be used for the printing of each sheet of each print job in the printing spool 112. Additional methods and/or additional device or components may be utilized in the printing of each sheet of at least one print job 114A and any additional print jobs queued in the printing spool 102, e.g., print job 114B, in addition to and/or in lieu of those depicted above.

The components of printer 100 may be connected, coupled, or otherwise communicate by communications channel 134 which may be, for example, a bus.

Figure 2:
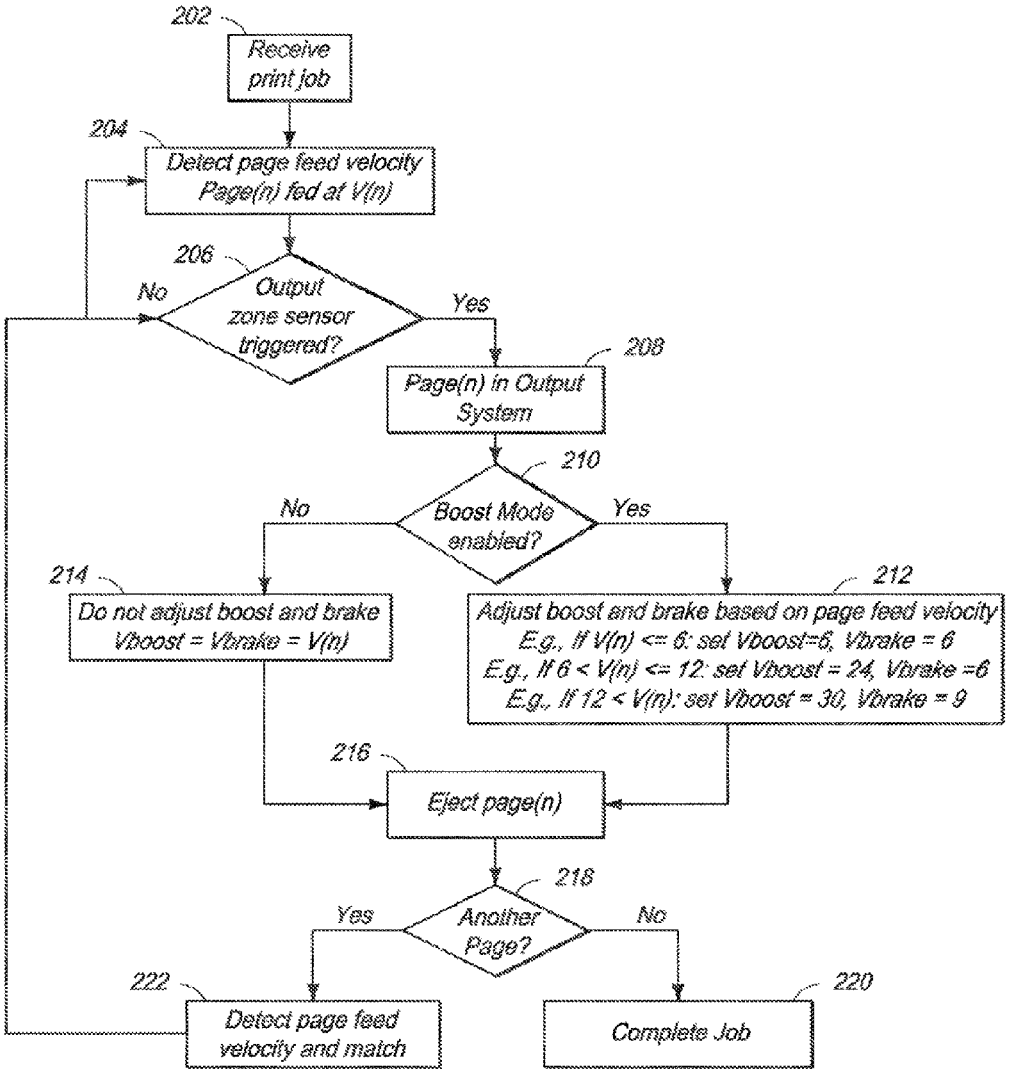
FIG. 2 is a flowchart of a method for accelerating and decelerating print media in an output zone, according to an example of the present disclosure.

FIG. 2 is a flowchart of a method for accelerating and decelerating print media in an output zone, according to an example of the present disclosure.

In block 202, a print job is received. In some examples, the print job may be received by print controller 102 via a network interface 130 from, e.g., a desktop computer, a mobile device, a server, a retail point of sale device, or another electronic device. The job may be stored in printing spool 112 as, e.g., print job 114A. The sheet advancement system 126 and image printing system 128 may commence the print job by feeding at least one sheet or page from an input bin into a page feed zone, through a printing system, and into an output zone, as discussed below in more detail with respect to FIG. 4.

In block 204, the page feed velocity of a first page may be detected as the page approaches or enters the output zone. The page feed velocity may be measured in, for example, inches per second. A page may be fed into the output zone, in some examples, at a range of 1 inch per second through 12 inches per second, although a wide range of feed velocities may be possible depending on the print technology used in printer 100. In some examples, the page feed velocity may be measured with a media sensor, while in other examples the page feed velocity may be measured by a sensor embedded in a roller or other media movement component.

In block 206, a page passing from a feed zone into an output zone may be detected. The page passing into or through the output zone may be detected by a media sensor, such as media sensor 132 discussed above with respect to FIG. 1 and below with respect to FIG. 4.

If the media sensor or other component detects a page in the output zone in block 206, or in some examples a page completely in the output zone, the flow proceeds to block 208 which indicates to print controller 102 or other component that the page is in the output zone.

In an example, a "boost" or accelerate/decelerate mode may have been enabled or disabled by a user or administrator prior to printing, either enabling or disabling the functionality described herein. In block 210, a determination is made as to whether the boost mode is enabled.

In the event that the boost mode is enabled, the flow of FIG. 2 continues to block 212. In block 212, the acceleration (or "boost") and deceleration (or "brake") of the page is adjusted, determined, or otherwise calculated based on the page feed velocity detected in block 204. In one example, if the page feed velocity is less than or equal to a value of 6 inches per second, the acceleration and brake values may be set, or remain at, the value of 6 inches per second. In such an example, block 212 may have determined that the page feed velocity is sufficiently low to allow the page to eject in a controlled fashion, and sufficiently high to allow a gap between the page and a second page that may follow. In some examples, the determination of block 212 may be pre-determined or set in software loaded onto a printer at the factory, or later loaded or updated via, e.g., a firmware update that may be downloaded over, e.g., the internet.

In another example, if the page feed velocity is between 7 inches per second and 12 inches per second, the acceleration value may be set to 24 inches per second, and the brake value may be set at 6 inches per second. In such an example, block 212 may have determined that the page velocity was too high to allow for ejection in a controlled fashion. However, simply braking the page to 6 inches per second without first accelerating the page would leave an insufficient gap between the first page and the second page. Accordingly, the page may first be accelerated to 24 inches per second before being braked at 6 inches per second.

In another example, if the page feed velocity is higher than 12 inches per second, the acceleration value may be set to 30 inches per second, and the brake value may be set at 9 inches per second. In such an example, as above, block 212 may have determined that the page velocity was too high to allow for ejection in a controlled fashion. However, simply braking the page to 9 inches per second, for example, without first accelerating the page would leave an insufficient gap between the first page and the second page. Accordingly, the page may first be accelerated to 30 inches per second before being braked at 9 inches per second.

It will be appreciated that other combinations of acceleration and deceleration may be used to boost and brake a page once a media sensor is triggered in the output zone.

In some examples, the braking or deceleration may occur as the tail end of the page exits the printer. For example, the deceleration in page velocity may occur as the last half inch or last inch of the page exits the printer. A media sensor may be employed to determine the amount of page left in the printer, e.g., within the final pinch zone, or a calculation of page velocity and media length may be used to determine when to brake the page.

In the event that the boast mode is not enabled, the flow of FIG. 2 continues to block 214. In block 214, the acceleration and deceleration values are not adjusted. For example, the speed of the gears, brakes, motors, rollers, and/or other internal components of the output zone will continue to rotate at the currant speed.

In block 216, the page is fully ejected from the printer, e.g., into an output bin.

In block 218, the print controller 102 may determine whether there is another page in the print job, i.e., in print spool 112. If there is no additional page to be printed, the job will complete in block 220.

If the print controller 102 determines in block 218 that there is another page in the print job, flow proceeds to block 222 where the feed velocity of the next page is detected, and the velocity of the gears, brakes, motors, rollers, and/or other internal components of the output zone are accelerated or decelerated to match the speed of the next page entering from the feed zone.

Although the flowchart of FIG. 2 shows a specific order of performance of certain functionalities, the method of FIG. 2 is not limited to that order. For example, the functionalities shown in succession in the flowchart may be performed in a different order, may be executed concurrently or with partial concurrence, or a combination thereof. In some examples, functionalities described herein in relation to FIG. 2 may be provided in combination with functionalities described herein in relation to any of FIGS. 1-5. All of the features disclosed in this specification (including any accompanying claims, abstract and drawings), and/or all of the steps of any method or process so disclosed, may be combined in any combination, except combinations where at least some of such features and/or steps are mutually exclusive.

Figure 3:
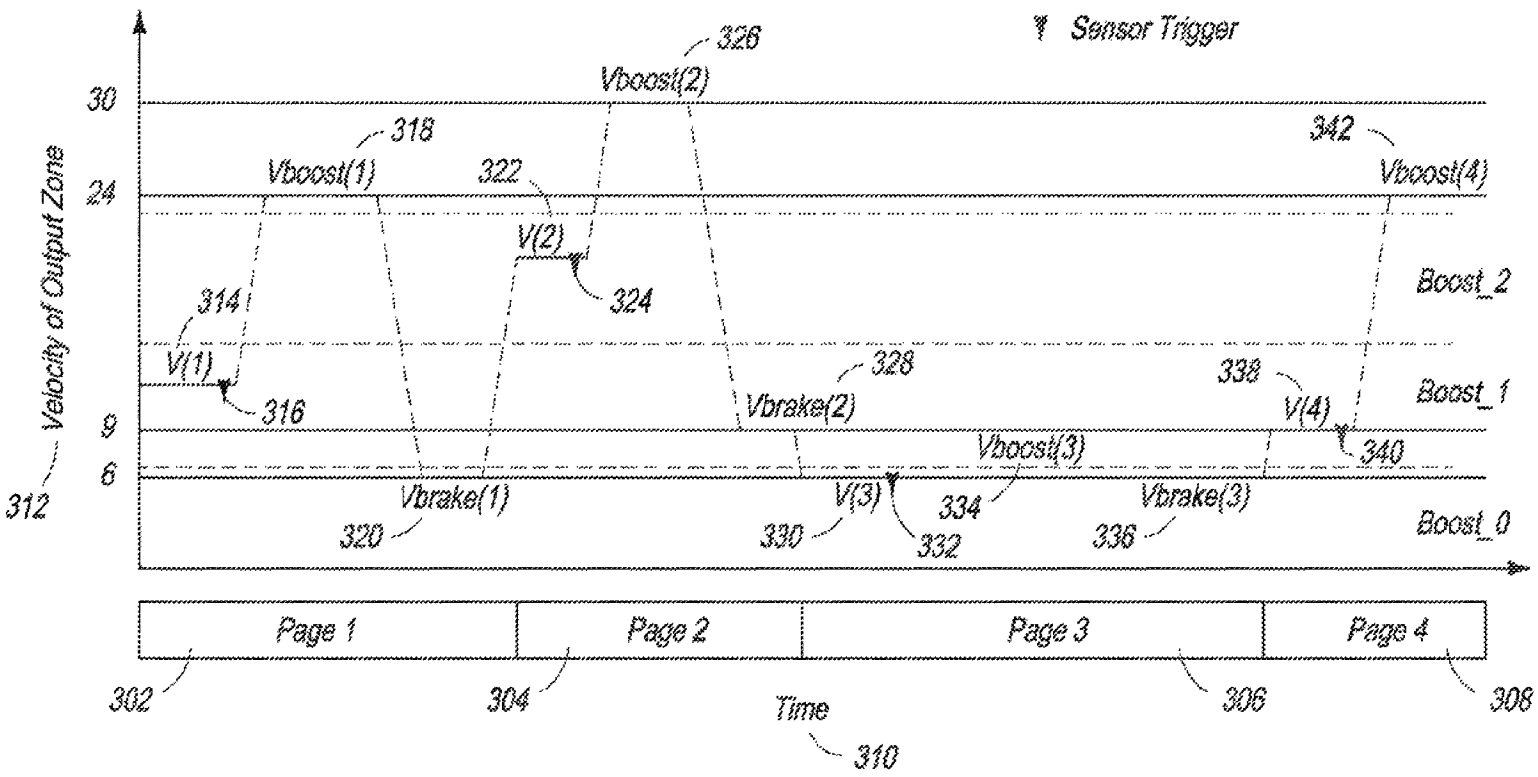
FIG. 3 is a velocity profile of accelerating and decelerating print media in an output zone, according to an example of the present disclosure.

FIG. 3 is a velocity profile of accelerating and decelerating print media in an output zone, according to an example of the present disclosure. In FIG. 3, the X axis represents pages 302-308 along a time 310, and the Y axis represents the page velocity 312 in the output zone measured in inches per second.

In the example of FIG. 3, Page 1 approaches the output zone of the printer at a first feed velocity 314 of approximately 12 inches per second. A media sensor is triggered at 316, indicating that Page 1 is now fully in the output zone of the printer. In the example of FIG. 3, the velocity of Page 1 in the output zone is accelerated to a first boost speed 318 of approximately 24 inches per second. As the page is ejected, the output zone is decelerated to a first brake velocity 320 of approximately 6 inches per second and Page 1 is ejected.

As discussed above, in some examples, the braking or deceleration may occur as the tail end of the page exits the printer. For example, the deceleration in page velocity may occur as the last half inch or last inch of the page exits the printer. A media sensor may be employed to determine the amount of page left in the printer, e.g., within the final pinch zone, or a calculation of page velocity and media length may be used to determine when to brake the page.

Continuing with the example of FIG. 3, Page 2 approaches the output zone of the printer at a second feed velocity 322 of approximately 20 inches per second, and the output zone is accelerated to match that second feed velocity 322. A media sensor is triggered at 324, indicating that Page 2 is now fully in the output zone of the printer. In the example of FIG. 3, the velocity of Page 2 in the output zone is accelerated to a second boost speed 326 of approximately 30 inches per second. As the page is ejected, the output zone is decelerated to a second brake velocity 328 of approximately 9 inches per second and Page 2 is ejected.

Continuing with the example of FIG. 3, Page 3 approaches the output zone of the printer at a third feed velocity 330 of approximately 6 inches per second, and the output zone is decelerated to match that third feed velocity 330. A media sensor is triggered at 332, indicating that Page 3 is now fully in the output zone of the printer. In the example of FIG. 3, the velocity of Page 3 does not need to be accelerated, and remains at 6 inches per second as represented by a third boost speed 334. As the page is ejected, the output zone similarly does not need to be decelerated and remains at approximately 6 inches per second, as represented by a third brake velocity 336 of 6 inches per second.

Concluding the example of FIG. 3, Page 4 approaches the output zone of the printer at a fourth feed velocity 338 of approximately 9 inches per second. A media sensor is triggered at 340, indicating that Page 4 is now fully in the output zone of the printer. In the example of FIG. 3, the velocity of Page 4 in the output zone is accelerated to a fourth boost speed 342 of approximately 24 inches per second. The example velocity profile of FIG. 3 may continue as necessary until all pages are printed from, e.g., print spool 112.

Figure 4:
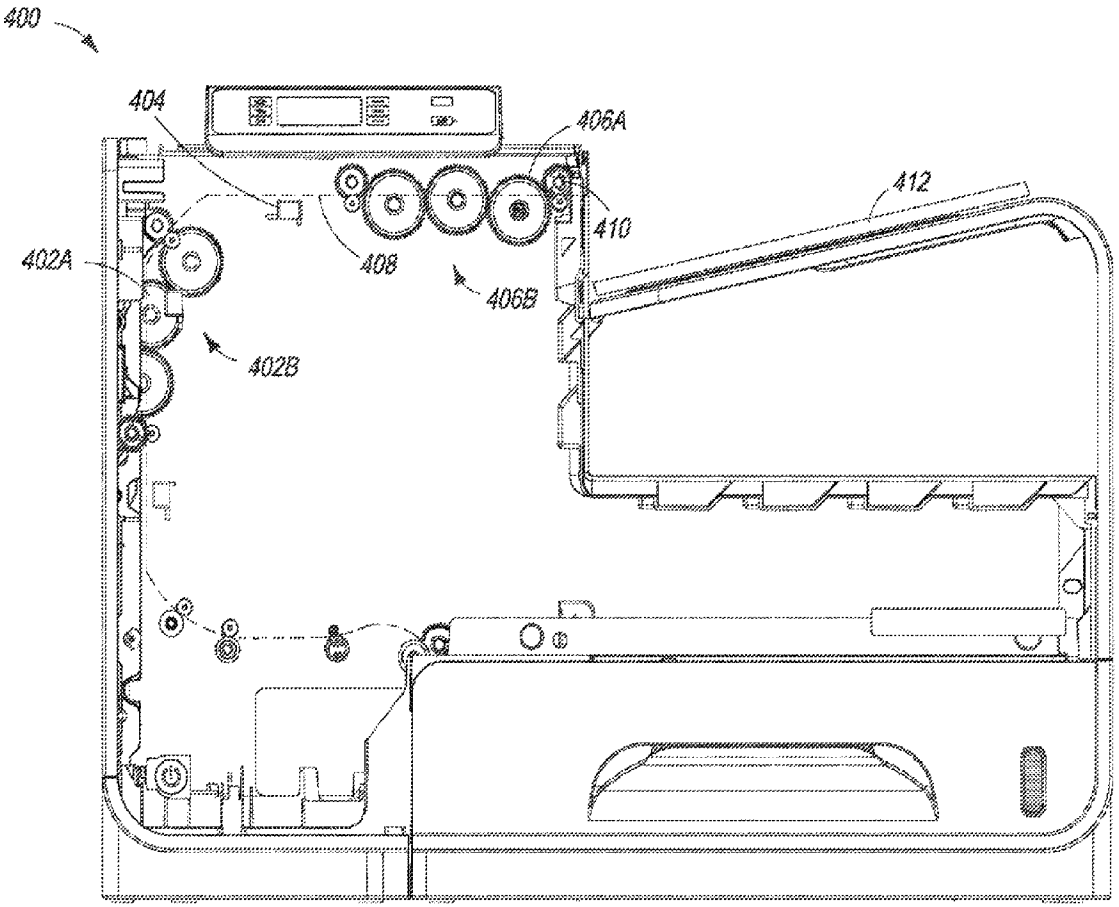
FIG. 4 is an image forming apparatus for printing at variable speeds, according to an example of the present disclosure.

FIG. 4 is an image forming apparatus for printing at variable speeds, according to an example of the present disclosure. The apparatus of FIG. 4 may include one or more outputting mechanisms that may be utilized to transfer pages, sheets, or other media out of a printing apparatus, e.g., out of printer 400. In some examples, the media may follow path 408 from an input bin, through the printer, and out to an output bin 410.

In an example, one or more outputting mechanisms may include one or more rollers or gears 402A in a feed zone 402B, and one or more rollers or gears 406A in an output zone 406B. Each roller or gear may be in the shape of a sphere, cylinder, or any other uniformly round shape. Further, each roller or gear may be mounted on a bar and/or rod, which may be attached to the printing apparatus and rotated. Each roller or gear may independently or in conjunction be driven to rotate at various speeds by a motor whenever a page of a print job is to be outputted from the printing apparatus. As discussed herein the rate and speed of rotation for one or more rollers or gears may be adjusted by print controller software sending instructions for the motor, connected to the rollers and/or gears, to accelerate or decelerate. By adjusting the speed of rotation for each roller or gear independently or conjunctively, a sheet may be accelerated or decelerated and the distance a sheet travels when outputted from the printing apparatus may be controlled.

Printer 400 may also include one or more media sensors such as media sensor 404. As discussed above, media sensor 404 may also detect which part of a medium is passing by the sensor at any given time. For example, media sensor 404 may detect that the trailing edge, or the last inch, of a sheet is passing the sensor.

Printer 400 may also comprise a brake zone 410 from which a page may be elected. Brake zone 410 may include one or more pinch points.

Additional devices and/or components, including additional rollers and/or air nozzles, may be utilized to transfer sheets out of a printing apparatus and into an output bin tray in addition to and/or in lieu of those depicted in FIG. 4.

Figure 5:
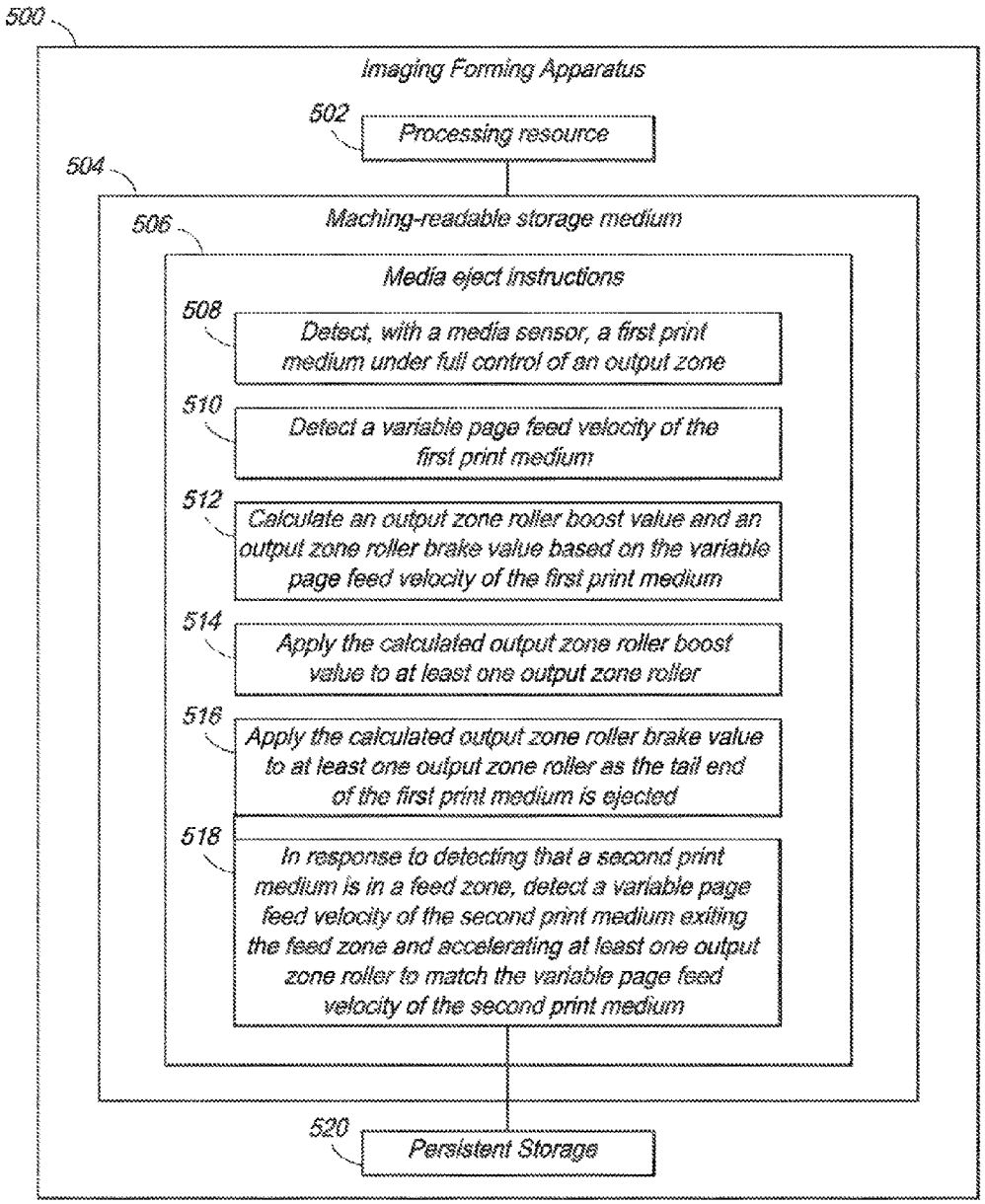
FIG. 5 illustrates a schematic representation of a device that may be used as a platform for implementing or executing at least one of the processes depicted in FIG. 2, according to an example of the present disclosure.

FIG. 5 illustrates a schematic representation of a device that may be used as a platform for implementing or executing at least one of the processes depicted in FIG. 2, according to an example of the present disclosure. The device of FIG. 5 may include a machine-readable storage medium discussed above in more detail with respect to FIG. 1.

In the example of FIG. 5, in block 508, instructions stored on a machine-readable storage medium may detect, with a media sensor, a first print medium under full control of an output zone. In block 510, the instructions may detect a variable page feed velocity of the first print medium. In block 512, the instructions may calculate an output zone roller boost value and an output zone roller brake value based on the variable page feed velocity of the first print medium. In block 514, the instructions may apply the calculated output zone roller boost value to at least one output zone roller. In block 516, the instructions may apply the calculated output zone roller brake value to at least one output zone roller as the tail end of the first print medium is ejected, and in block 518 the instructions may, in response to detecting that a second print medium is in a feed zone, detect a variable page feed velocity of the second print medium exiting the feed zone and accelerating at least one output zone roller to match the variable page feed velocity of the second print medium.

In certain examples, the processes and instructions described herein may be at least partially implemented in digital electronic circuitry, in computer hardware, in machine readable instructions (such as firmware and/or software), or in any combination thereof.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A method for ejection of print media in an image forming apparatus, comprising:

detecting a variable page feed velocity of a first page of print media exiting a feed zone;

calculating an output zone acceleration value and an output zone deceleration value based on the variable page feed velocity of the first page;

applying the calculated output zone acceleration value to a media movement component in the output zone when the first page has cleared a media sensor at the front of the output zone;

applying the calculated output zone deceleration value to the media movement component in the output zone as the tail end of the first page is in a brake zone;

ejecting the first page; and in response to detecting that a second page of print media is in the feed zone, detecting a variable page feed velocity of the second page exiting the feed zone and accelerating the media movement component in the output zone to match the variable page feed velocity of the second page.

2. The method of claim 1, wherein the output zone acceleration value is increased to a value sufficient to compensate for a subsequent output zone deceleration.

3. The method of claim 1, wherein the output zone deceleration value is increased to a value sufficient to eject the first page.

4. The method of claim 1, wherein the tail end of the first page comprises a length of less than or equal to one inch.

5. The method of claim 1, wherein the media movement component comprises at least one of a roller, gear, and motor.

6. A print media ejection system comprising:

a feed zone comprising at least one roller;

an output zone comprising at least one roller;

an output zone media sensor;

a module to accelerate and decelerate print media in the output zone based on a page feed velocity of at least one sheet of print media;

the output zone media sensor to detect that a first sheet is entirely in the output zone and to trigger the module to accelerate the first sheet to create a gap between the first sheet and a second sheet to be ejected after the first sheet;

the module to decelerate the first sheet to eject the tail end of the first sheet; and the module to accelerate the output zone to match a page feed velocity of the second sheet in response to ejection of the first sheet.

7. The system of claim 6, wherein the page feed velocity is detected by at least one sensor disposed in the feed zone.

8. The system of claim 6, further comprising a pinch zone to eject the tail end of the first sheet.

9. The system of claim 8, wherein the module is to calculate a length of the tail end of the first sheet.

10. The system of claim 6, wherein the module is user-configurable based on at least one of user preference and media type.

11. A non-transitory computer readable storage medium for print media ejection on which is embedded a computer program, which when executed, causes a computing device to:

detect, with a media sensor, a first print medium under full control of an output zone;

detect a variable page feed velocity of the first print medium;

calculate an output zone roller boost value and an output zone roller brake value based on the variable page feed velocity of the first print medium;

apply the calculated output zone roller boost value to at least one output zone roller;

apply the calculated output zone roller brake value to at least one output zone roller as the tail end of the first print medium is ejected; and in response to detection of a second print medium in a feed zone, detect a variable page feed velocity of the second print medium exiting the feed zone and accelerate at least one output zone roller to match the variable page feed velocity of the second print medium.

12. The computer readable storage medium of claim 11, wherein the output zone roller boost value is increased to a value sufficient to compensate for a subsequent output zone deceleration.

13. The computer readable storage medium of claim 11, wherein the output zone roller brake value is increased to a value sufficient to eject the first print medium.

14. The computer readable storage medium of claim 11, wherein the tail end of the first print medium comprises a length of less than or equal to one inch.

15. The computer readable storage medium of claim 11, wherein the tail end of the first print medium is ejected from a pinch zone.

* * * * *